United States Patent [19]

Yamamoto

[11] Patent Number: 4,619,402

[45] Date of Patent: Oct. 28, 1986

[54] NOZZLE FOR SPRAYING AGRICULTURAL CHEMICALS

[75] Inventor: Kenzo Yamamoto, Wakayama, Japan

[73] Assignee: Yamaho Kogyo Co., Ltd., Wakayama, Japan

[21] Appl. No.: 622,266

[22] Filed: Jun. 19, 1984

[30] Foreign Application Priority Data

May 10, 1984 [JP] Japan ..... 59-68922[U]

[51] Int. Cl.[4] ..... B05B 7/04

[52] U.S. Cl. ..... 239/428.5; 239/434; 239/599; 239/600; 239/601

[58] Field of Search ..... 239/428.5, 431, 599, 239/600, 601

[56] References Cited

U.S. PATENT DOCUMENTS

| | | | |
|---|---|---|---|
| 2,366,354 | 1/1945 | Robbins | 239/428.5 |
| 2,543,294 | 2/1951 | McCabe | 239/428.5 X |
| 3,488,006 | 1/1970 | Gigantino | 239/599 |
| 3,754,710 | 8/1973 | Chimura | 239/601 X |
| 4,157,163 | 6/1979 | Pinto et al. | 239/600 X |
| 4,330,086 | 5/1982 | Nysted | 239/428.5 X |

FOREIGN PATENT DOCUMENTS

| | | | |
|---|---|---|---|
| 341858 | 12/1904 | France | 239/599 |
| 810733 | 3/1937 | France | 239/431 |
| 53-172872 | 12/1978 | Japan . | |

*Primary Examiner*—Joseph F. Peters, Jr.
*Assistant Examiner*—Mary Beth O. Jones
*Attorney, Agent, or Firm*—Wenderoth, Lind & Ponack

[57] ABSTRACT

A spray nozzle has a tubular body, an orifice plate, a tubular nozzle, and a nut for fastening the tubular body, the orifice plate, and the tubular nozzle together. The tubular nozzle is formed at its outer tip with a hole in the shape of an ellipse with a major axis and a minor axis. Inner walls of the tubular nozzle along the minor axis of the ellipse-shaped hole are straight along the entire length of the tubular nozzle and only the inner walls of the tubular nozzle along the major axis of the ellipse-shaped hole are tapered at the outer tip of the tubular nozzle.

1 Claim, 12 Drawing Figures

NOZZLE FOR SPRAYING AGRICULTURAL CHEMICALS

BACKGROUND OF THE INVENTION

1. Field of the Invention

The present invention relates to a nozzle for spraying agricultural chemicals.

2. Description of the Prior Art

Conventional spray nozzles of this type have a disadvantage that the spray droplets formed are so fine that they are liable to be windborne. Therefore, the present inventor proposed to make the spray droplets coarse by providing an ejector at the base of a nozzle so that air will be sucked and air bubbles be mixed with an agricultural chemical (Japanese Utility Model Application No. 53-172,872). As shown in FIGS. 1*a* and 1*b*, a passage 1 provided in the end portion of this previously proposed nozzle is gradually flattened toward its end so that the chemical fluid may be spouted at a required initial velocity. However, such a flattened nozzle end gives rise to a problem that a nozzle hole 2 provided at the end of the passage 1 might be blocked by the seeds of plants or the like sucked up through air holes during the spouting of the chemical fluid.

The above-described problem can be solved if the nozzle end is flattened to a lesser degree. However, this leads to another problem in that the initial velocity, hence the spray travel, of the spouted chemical fluid is decreased. Thus, the less flattened nozzle end is not satisfactory to solve the problems.

SUMMARY AND OBJECT OF THE INVENTION

It is an object of the present invention to provide an improved spray nozzle which obviates the possibility of being blocked by the seeds or the like and yet affords a sufficient initial spray velocity.

In order to achieve the above-mentioned object, the end of a tubular nozzle in accordance with the present invention is provided with an elliptical nozzle hole and has its inner wall tapering toward said elliptical hole.

The chemical fluid is turned inwardly by the arcuate portions of the inner wall. Then the inward flows of the chemical fluid strike against each other at the nozzle hole and are spouted.

BRIEF DESCRIPTION OF THE DRAWINGS

With the above-described object in view and as will become apparent from the following detailed description, the present invention will be more clearly understood in connection with the accompanying drawings, in which.

DETAILED DESCRIPTION OF THE PREFERRED EMBODIMENT

Figure 2A:
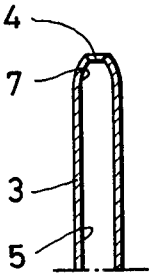
FIG. 2*a* is a sectional view of a nozzle according to the present invention taken along line IIa—IIa of FIG. 2*b;*
Figure 2B:
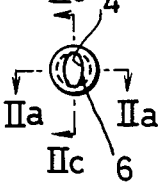
FIG. 2*b* is a plan view of the nozzle.
Figure 2C:
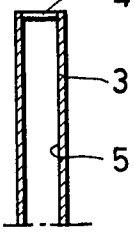
FIG. 2*c* is a sectional view taken along line IIc—IIc of FIG. 2*b;*

In accordance with the present invention, as shown in FIG. 2*b*, a nozzle 3 has a nozzle hole 4 of an elliptical shape. The inner surfaces of the nozzle 3 terminating in arcs 6 of the hole 4 only along the major axis of the ellipse are tapered, as shown in FIG. 2*a*. As shown in FIG. 2*c*, the inner surfaces of the nozzle 3 terminating in the arcs 6 of the hole 4 along the minor axis of the ellipse are straight along the entire extent of the nozzle 3. This shape can be conveniently formed at the outer tip 13 as in the first embodiment described below.

Figure 3:
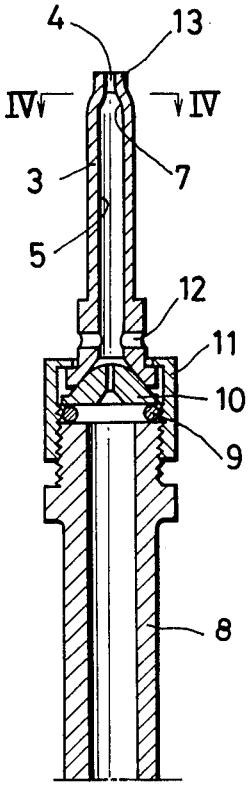
FIG. 3 is a sectional view of the first embodiment of the present invention.
Figure 4:
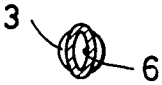
FIG. 4 is a sectional view thereof taken along line IV—IV of FIG. 3.
Figure 5:
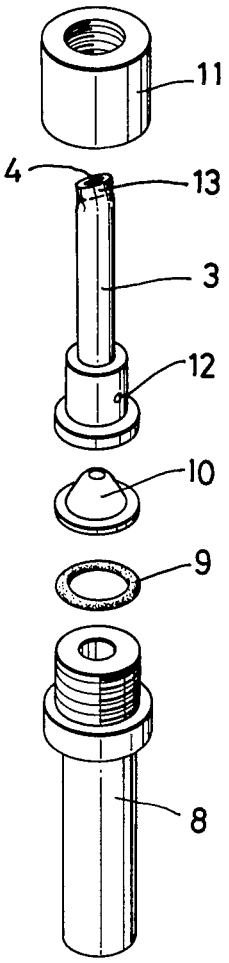
FIG. 5 is an exploded perspective view thereof.

Referring now to FIGS. 3 to 5, the first embodiment of the present invention includes a nozzle body 8, an orifice plate 10 placed on the upper end of the nozzle body 8 with a packing 9 interposed therebetween, a nozzle 3 placed on the orifice plate 10, and a locknut 11 screwed on the nozzle body 8 to hold together the nozzle 3, orifice plate 10 and the nozzle body 8 securely.

Air holes 12 communicating with the internal passage 5 are provided at the base of the tubular nozzle 3. The air holes 12 and the orifice plate 10 constitute an ejector for sucking air into the internal passage 5.

A nozzle hole 4 is formed by squeezing the end of the nozzle 3, as shown in FIG. 4, with a suitable tool so as to form an elliptical nozzle hole 4 with arcs 6. By this squeezing, as shown in FIG. 3, only portions 7 of the internal surface of the nozzle 3 just below the nozzle hole 4 are tapered.

Consequently, the chemical fluid flows pass through the orifice plate 10, go up along the tapered portions 7 of the internal passage 5, and guided thereby so as to strike against each other at the nozzle hole 4 and spout therefrom.

Figure 1A:
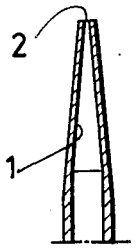
FIG. 1a PRIOR ART
FIG. 1*a* is a sectional view of a conventional nozzle.
Figure 1B:
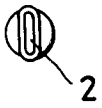
FIG. 1b PRIOR ART
FIG. 1*b* is a plan view thereof.

Although in the conventional nozzle shown in FIG. 1, too, the chemical fluid flows strike against each other in the gradually flattened passage 1, the nozzle 3 according to the present invention causes the chemical fluid flows to strike against each other more violently because the tapered portions 7 of the internal surface turn the fluid flows inwardly.

Figure 6:
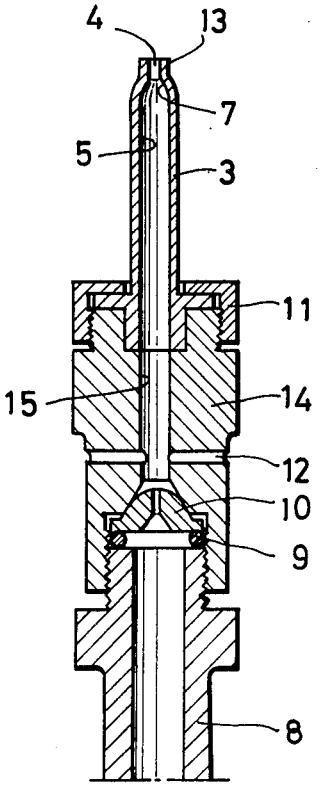
FIG. 6 is a sectional view of the second embodiment of the present invention.

Referring now to FIG. 6, the second embodiment of the present invention further includes an intermediate member 14 interposed between the nozzle body 8 and the nozzle 3 and connected to the nozzle body 8 by screwing it on the nozzle body 8 with the packing 9 and the orifice plate 10 interposed therebetween. The nozzle 3 is coupled to the intermediate member 14 by the locknut 11. Air holes 12, through which a center hole 15 communicates with the outside, are provided in the intermediate member 14, not in the nozzle 3. The air holes 12 and the orifice plate 10 constitute an ejector. The nozzle hole 4 in the nozzle 3 is constructed in the same manner as in the first embodiment.

Figure 7:
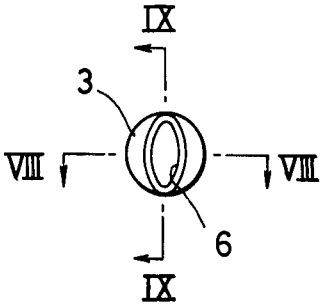
FIG. 7 is a plan view of the third embodiment of the present invention.
Figure 8:
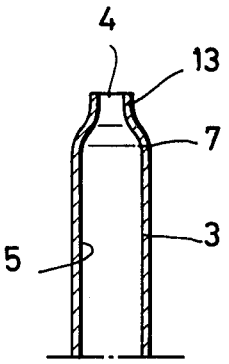
FIG. 8 is a sectional view taken along line VIII—VIII of FIG. 7.
Figure 9:
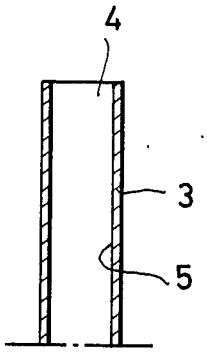
FIG. 9 is a sectional view taken along line IX—IX of FIG. 7.

Referring now to FIGS. 7 to 9, the third embodiment of the present invention is suited to be made of a hard material such as a ceramic. The nozzle hole 4 is formed in such a manner that the length of its major axis is made equal to the diameter of the internal passage 5. In other respects, this embodiment is the same as the second embodiment.

The nozzle in accordance with the present invention has an advantage that, even if it has a larger nozzle hole 4 than in the conventional nozzles, the impetus given to the spouted chemical fluid is substantially equal to that given thereto by the conventional nozzles, because the chemical fluid is guided along the tapered portions 7 of the internal surface. Because of the elliptical nozzle hole 4, the possibility of blockage by the seeds is eliminated and yet the nozzle in accordance with the present invention ranks with any of the conventional nozzles in spray travel.

I claim:

1. A spray nozzle for spraying agricultural chemicals comprising:

a tubular body;

an orifice plate formed with an orifice and mounted on one end of the tubular body;

a tubular nozzle mounted on the orifice plate and formed with air holes of a given diameter each at a base portion thereof so as to allow outside air to communicate with all inner walls of the tubular nozzle; and nut means, mounted on the tubular nozzle, for fastening the tubular nozzle, the orifice plate, and the tubular body together;

said tubular nozzle having at an outer tip thereof a hole in the shape of an ellipse with a major axis and a minor axis, said minor axis having a length greater than the given diameter of each of the air holes;

wherein the inner walls of the tubular nozzle along the minor axis of the ellipse-shaped hole are straight along the entire length of the tubular nozzle and only the inner walls of the tubular nozzle along the major axis of the ellipse-shaped hole are tapered at the outer tip of the tubular nozzle;

whereby the possibility of the hole in the shape of the ellipse at the outer tip being blocked by seeds sucked up through the air holes is obviated, yet a sufficient initial velocity for the agricultural chemicals being sprayed through the hole is afforded.

* * * * *